United States Patent [19]

Horne

[11] 4,264,077

[45] Apr. 28, 1981

[54] BOARD GAME

[76] Inventor: Ian R. Horne, 12, Salisbury Close, Wokingham, Berkshire, England

[21] Appl. No.: 28,652

[22] Filed: Apr. 10, 1979

[30] Foreign Application Priority Data

Apr. 25, 1978 [GB] United Kingdom ..... 16241/78

[51] Int. Cl.[3] ..... A63F 3/00

[52] U.S. Cl. ..... 273/249

[58] Field of Search ..... 273/236, 242, 243, 248, 273/249, 250, 251, 252, 253, 254

[56] References Cited

U.S. PATENT DOCUMENTS

| | | | |
|---|---|---|---|
| 798,170 | 8/1905 | Cross | 273/258 X |
| 1,578,402 | 3/1926 | Cross | 273/248 |
| 1,883,651 | 10/1932 | Ensley | 273/248 |
| 2,178,330 | 10/1939 | Thomas | 273/254 |
| 2,194,854 | 3/1940 | Howard | 273/248 |

FOREIGN PATENT DOCUMENTS

| | | | |
|---|---|---|---|
| 973037 | 10/1964 | United Kingdom | 273/248 |

*Primary Examiner*—Richard C. Pinkham
*Assistant Examiner*—Scott L. Brown
*Attorney, Agent, or Firm*—Fulwider, Patton, Rieber, Lee & Utecht

[57] ABSTRACT

A board game comprising a board providing in sequence a base zone, a conflict zone and a scoring zone, the conflict zone including a plurality of protectable numbered positions and a plurality of neutral numbered positions interspersed among the protectable positions, a plurality of pieces for passage during the game from the base to the scoring zone, a plurality of indicators for location at said protectable positions and a pair of dice for determining the passage of said pieces through the zones.

3 Claims, 1 Drawing Figure

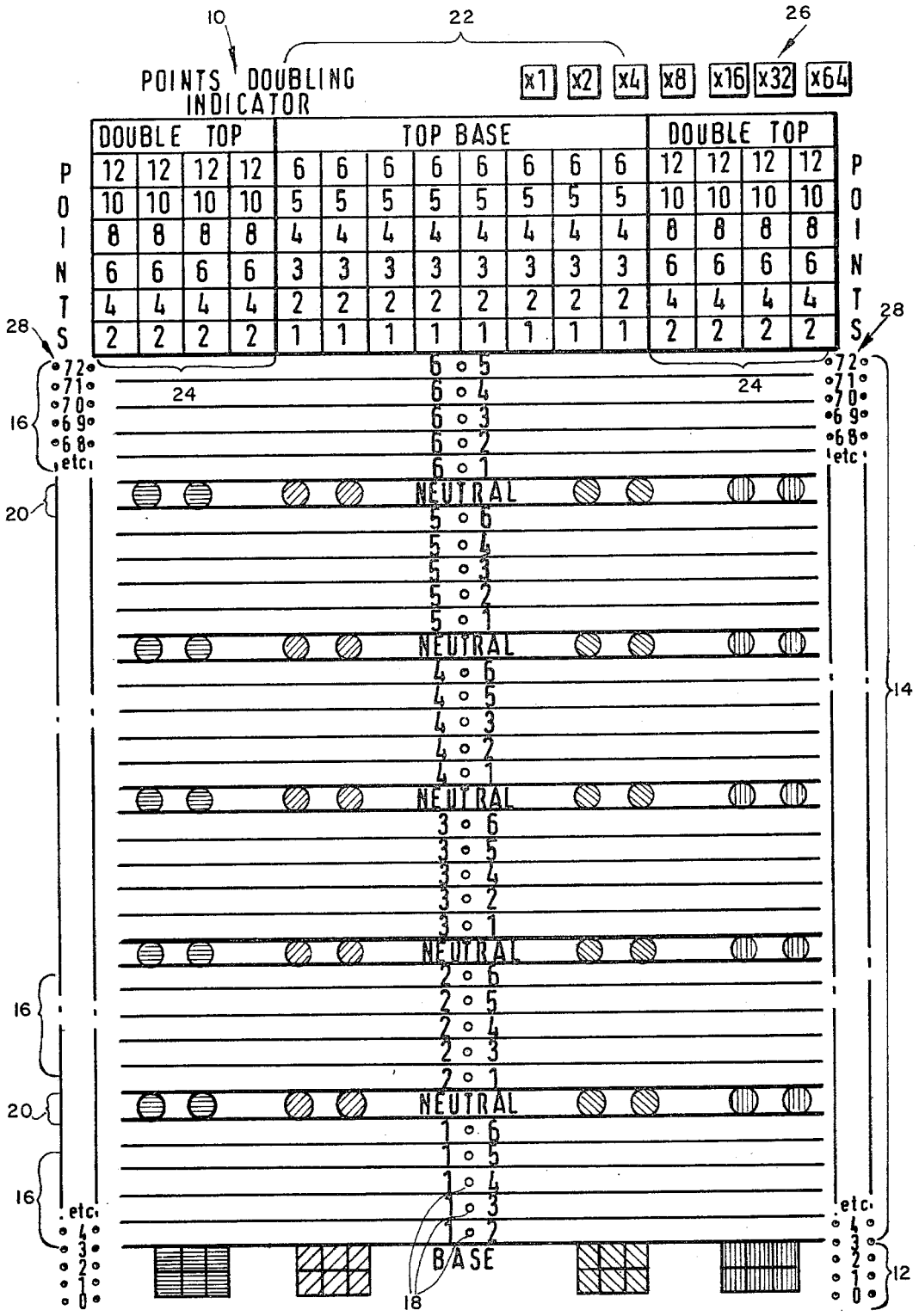
10
22
26
POINTS DOUBLING INDICATOR
x1 x2 x4 x8 x16 x32 x64
DOUBLE TOP
TOP BASE
DOUBLE TOP
POINTS
28
24
16
20
14
12
18
6 o 5
6 o 4
6 o 3
6 o 2
6 o 1
NEUTRAL
5 o 6
5 o 4
5 o 3
5 o 2
5 o 1
NEUTRAL
4 o 6
4 o 5
4 o 3
4 o 2
4 o 1
NEUTRAL
3 o 6
3 o 5
3 o 4
3 o 2
3 o 1
NEUTRAL
2 o 6
2 o 5
2 o 4
2 o 3
2 o 1
NEUTRAL
1 o 6
1 o 5
1 o 4
1 o 3
1 o 2
BASE
etc.

BOARD GAME

This invention relates to a board game for two or more players. According to the invention there is provided: a board game comprising a board providing in sequence a base zone, a conflict zone and a scoring zone, the conflict zone including a plurality of protectable numbered positions and a plurality of neutral positions interspersed among the protectable positions, a plurality of pieces for passage during the game from the base to the scoring zone, a plurality of indicators for location at said protectable positions, and a pair of dice for determining the passage of said pieces through the zones.

An embodiment of the invention will now be described by way of example only with reference to the accompanying diagram which is a diagrammatic view of the board of a board game according to the present invention, the board as shown being for two, three or four players and may be expanded to accommodate more than four players.

Referring to the drawing the board 10 includes a base zone 12 having spaces for a plurality of (in this case six) pieces for each player. Above the base zone is a conflict zone 14 through which the pieces must advance to reach a scoring zone, including a plurality of protectable numbered positions 16 each with a peg hole 18 and a plurality of neutral positions 20 without a peg hole, interspersed (in this case evenly) among the protectable positions.

The conflict zone is numbered progressively from 12 to 65, the numbers being derived from the throwing of a pair of dice and discounting the doubles; a throw of 4 and 6 for example gives numbers 46 and 64. In the conflict zone pieces can be knocked off and returned to base zone 12, except when resting on one of the Neutral Positions (with spaces for one, two, three or four pieces for each player) or on a positioned protected by a player's peg.

The scoring zone is divided into a six point-level top zone 22 and an adjacent six point level double top zone 24. The value of a piece in the scoring zone is marked on the square on which it rests and is between 1 and 12.

At the top of the board is a doubling indicator 26 which is used to indicate the value of the multiplier to be used at the end of the game in calculating each players score.

On each side of the conflict zone are points indicators 28 to show the state of each players score during a game.

In addition to the board 10, each player is provided with six pieces and a plurality of (in this case twelve) pegs, (not shown) of the same colour, and the game is played with a pair of dice and according to the rules set out below. The pieces and pegs of the other players are of different colours.

The object of the game is to score the maximum number of points by advancing one's pieces from the base zone via the conflict zone to the "scoring" zone so that they occupy the highest levels in the top base zone with as many as possible promoted to the double top zone in order to achieve the highest number of points. The total of each player's pieces in the scoring zone being multiplied by the value of the Points Doubling Indicator to provide the final points tally. The player with the highest tally is the winner.

The rules are as follows:

Pieces and Pegs

For a normal game each player has 6 pieces and 12 pegs of the same colour. For a quicker game players can agree to use fewer pieces but still have 12 pegs each.

An extra peg is provided for each player to mark his score on the Points Indicator.

Alliances

When four people are playing they may form Alliances and play one pair against the other. In an Alliance players share the advantages of each other's protected (pegged) positions and do not knock off their partner's pieces.

At the end of the game the points scored by both partners are totalled and the winning pair is the one with the higher total points.

Alliances may only be made before the game starts.

Partners in an Alliance may confer in making moves.

Order of Play

Each player throws the dice and the order of play is highest throw first, next highest second and so on.

When playing Alliances a player from one Alliance must be followed by a player from the other Alliance.

A Player's Turn

The player shakes both dice together and throws onto a flat surface. He must leave the dice exposed to view until he has completed his turn by picking up the dice. If he picks up the dice before making a move then the turn is lost. Once he has picked up the dice he cannot alter his move. A player not wishing to make a move can simply pick up the dice.

A player throwing a double has another turn.

For each turn the throw of dice can be used in one of the following ways:

(A) To move a piece.

(B) To set up or remove Protected (pegged) positions.

(C) To knock off opponent pieces.

(D) To move the Points Doubling Indicator.

(A) Moving Pieces

On each turn the throw of dice is totalled (e.g. a throw of 4–6 totals 10) and one piece only is moved by that number of positions.

Moving Pieces from Base

A piece may be moved out of Base on any turn, for example with a throw of 4 and 6 a piece can be moved from Base to position 25.

Moving a Piece in the Conflict Zone

A Piece may be moved forwards or backwards by the total of the dice throw. The advantage of a backward move may be to knock off opponent pieces or to reach the safety of a Neutral or Protected (pegged) position.

A player may not have more than 2 pieces on the same Neutral position.

A piece may not move directly, i.e. in one turn from one Neutral position to another.

A player is not allowed to move a piece into the scoring zone while any of his pieces remain in the Base zone.

Moving a Piece into Top Base

Pieces leaving the Conflict Zone will land on one of six levels in Top Base. The points value of the piece is marked on each of the squares of that level.

Once a piece has entered Top Base it may not be moved forwards or backwards, it must stay on the level it lands on.

Players must balance the risk of delaying entry to Top Base to a later turn, hoping to land on a higher level and get more points, against the chances of being knocked off.

With a throw of 4 and 6 a piece on position 54 lands on level 3 and has a points value of 3.

A piece cannot enter Top Base if the dice throw is too high, e.g. a throw of 4 and 6 would be too high for a piece on positions 65, 64, 63 and 62, but a piece on position 61 would land on level 6 and achieve the maximum value of 6 points.

Moving a Piece into DOUBLE TOP

When a player throws a double he may promote a piece from Top Base to Double Top if the number on the dice corresponds to the level of the piece, e.g. if a player throws 5—5 he may promote one piece from Top Base level 5 to Double Top level 5 increasing its points value from 5 to 10 points.

A piece cannot be promoted to Double Top if the level on which it would land is already fully occupied.

If a piece enters the Scoring Zone on a double it automatically moves into Double Top unless the level on which it would land is fully occupied, in which case it would move into Top Base, e.g. with a throw of 5—5 a piece on position 54 would move into Double Top level 3 and have a points value of 6 points, however, if Double Top level 3 was already full the piece would move into Top Base level 3 and have a points value of 3 points.

A piece in Double Top cannot make any further move, it must stay at the level it lands on.

(B) Protected Positions and the Use of Pegs

Instead of moving a piece a player can use his turn to establish Protected Positions or to move his opponent's Protected Positions.

If a player throws a 4 and 6 he can set up Protected Positions by placing his coloured pegs in positions 46 and 64. The positions are Protected since any of the players own pieces resting on these positions are safe from being knocked off and returned to Base.

If an opponent already has pegs in positions 46 and 64 then these can be moved, but any pieces on these positions are protected from being knocked off on that turn, but are exposed to knocking off next turn.

The pegs are returned to the player who may use them again on a later turn if required.

If an opponent has a peg at 46 but position 64 is free the throw of 4 and 6 can be used to remove the opponent Protected Position at 46 and to set up a Protected Position at 64 by pegging it. A Protected Position cannot be established at 46 until another turn.

(C) Knocking off Opponent Pieces

A player can use his turn to knock off opponent pieces—all opponent pieces on positions corresponding to a dice throw can be returned to Base, e.g. with a throw of 4 and 6 all opponent pieces at positions 46 and 64 can be returned to Base if any are not protected.

If there are opponent pieces at position 46 and none at 64 then the throw can be used to return the opponent pieces at position 46 to Base and set up a Protected Position at 64 by pegging it, or if 64 was an opponent Protected Position then this can be removed.

If after picking up the dice a player notices that opponent pieces should have been returned to Base on his turn, the opportunity is lost, it is too late to return those pieces to Base.

A piece returned to Base can move back into the Conflict Zone on the player's next turn.

When a piece moves from Base, from a Neutral Position, from its own Protected Position, or from its partner's Protected Position (in an Alliance) then all opponent pieces at the position it lands on are returned to Base but with the following exceptions:

1. Pieces in the Scoring Zone—Top Base and Double Top can never be knocked off.
2. Pieces on Neutral Positions can never be knocked off.
3. Pieces on Protected Positions cannot be knocked off on that turn.

If a player decides to land his piece on an opponent's Protected Position then his piece is returned to Base but the opponent's peg is removed exposing any of his pieces on that position to knocking off next turn.

(D) Moving the Points Doubling Indicator

On any turn a player may use his throw to double or halve the points at stake on the game instead of moving a piece or peg or knocking off an opponent.

A player first throws the dice, he then moves the counter one position right or left on the Indicator to double or halve the points. If he threw a double he has another turn and can again double or halve the points at stake by moving the counter one more position right or left.

Scoring

Each piece in Top Base has a points value equal to the level it is on, and each piece in Double Top has double that value as marked on the square on which is rests.

The state of each player's score during the game is shown on the Points Indicators located either side of the Conflict zone. After each piece enters Tope Base or is promoted to Double Top the player's Indicator Peg must be moved up to indicate the total points of all his pieces in the Scoring Zone.

At the end of the game each player's total of points in the scoring Zone must be multiplied by the value of the points Doubling Indicator to give the final points position.

With the Points Doubling Indicator on X1 the maximum score would be achieved if the first player getting all his pieces into the Scoring Zone, which ends the game, had managed to promote his six pieces to Double Top level 6 giving a total of 72 points.

The maximum possible points would be achieved if the Points Doubling Indicator was on X64 and the points in the Scoring Zone totalled 72 giving a maximum possible points total of $64 \times 72 = 4608$ points.

Modifications to the above described game are possible, for example:

1. The zones could be laid out ladder wise, courtyard wise or circularly.
2. Players could have more or less than 6 pieces and 12 pegs each.

3. The board need not have a points doubling indicator.
4. The board could have more or less levels in Top Base and Double Top, and need not have Double Top, or could have further Doubled Bases e.g. X4, X8 etc.
5. An individual board may be provided for each player.
6. The dice numbered squares can be used in ascending or decreasing order or out of sequence.
7. The board could have more than one peg hole per position e.g. for multiple protection using 2 or more pegs.
8. The board may have individual scoring zones on the board instead of just one.
9. Points Indicators need not be incorporated in the board but could be provided separately or not at all.
10. The board could have positions referring a player to chance cards.
11. Instead of pegholes and pegs a players protected positions could be marked by distinctive counters in the players colour.

I claim:

1. A board game comprising a board providing in sequence a base zone, a conflict zone and a safe, scoring zone, the conflict zone including means defining a plurality of protectable numbered positions and a plurality of safe, neutral positions interspersed among the protectable positions, a plurality of pieces for passage during the game from the base to the scoring zone, a plurality of indicators for location at said protectable positions and a pair of dice for determining the passage of said pieces through the zones, the scoring zone for each piece including a top zone having six differently valued levels with values of 1 to 6 points.

2. The board game of claim 1, wherein the protectable positions of the conflict zone are numbered with double numbers in increasing value from the base zone to the scoring zone and derived from the throwing of the pair of dice.

3. A board game comprising a board providing in sequence a base zone, a conflict zone and a scoring zone, the conflict zone including means defining a plurality of protectable numbered positions and a plurality of neutral positions interspersed among the protectable positions, the scoring zone being divided into a top zone having six levels 1 to 6, and a double top zone having six levels 2 to 12, a plurality of pieces for passage during the game from the base to the scoring zone, a plurality of indicators for location at said protectable positions, and a pair of dice for determining the passage of said pieces through the zones.

* * * * *